US009837032B2

(12) United States Patent
Igawa

(10) Patent No.: US 9,837,032 B2
(45) Date of Patent: Dec. 5, 2017

(54) METHOD OF DRIVING DISPLAY PANEL AND DISPLAY APPARATUS FOR PERFORMING THE SAME

(71) Applicant: Samsung Display Co., Ltd., Yongin, Gyeonggi-Do (KR)

(72) Inventor: Masami Igawa, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 218 days.

(21) Appl. No.: 14/603,138

(22) Filed: Jan. 22, 2015

(65) Prior Publication Data

US 2015/0339995 A1 Nov. 26, 2015

(30) Foreign Application Priority Data

May 26, 2014 (KR) ..... 10-2014-0063006

(51) Int. Cl.
*G09G 3/36* (2006.01)

(52) U.S. Cl.
CPC ..... *G09G 3/3648* (2013.01); *G09G 3/3688* (2013.01); *G09G 2300/0408* (2013.01); *G09G 2300/0426* (2013.01); *G09G 2300/0871* (2013.01)

(58) Field of Classification Search
CPC ..... G09G 3/3648; G09G 3/3688; G09G 2300/0871; G09G 2300/0426; G09G 2300/0408
USPC ..... 345/87, 94–95, 98–100, 204–206, 345/211–213, 690–691
See application file for complete search history.

(56) References Cited

U.S. PATENT DOCUMENTS

2003/0001808 A1* 1/2003 Sakuma ..... G09G 3/3648 345/87
2010/0194731 A1* 8/2010 Hiratsuka ..... G09G 3/3688 345/211
2014/0176617 A1 6/2014 Jeong et al.
2014/0183481 A1 7/2014 Lee et al.
2014/0184663 A1 7/2014 Seo et al.
2014/0184666 A1 7/2014 Jun et al.
2014/0184969 A1 7/2014 Ro et al.
2014/0198028 A1 7/2014 Lee et al.
2014/0198134 A1 7/2014 Moon et al.
2014/0204051 A1 7/2014 Park et al.
2014/0204065 A1 7/2014 Park et al.
2014/0204323 A1 7/2014 Kim et al.
2014/0347257 A1 11/2014 Igawa

FOREIGN PATENT DOCUMENTS

KR 10-2007-0087404 A 8/2007

* cited by examiner

*Primary Examiner* — Amare Mengistu
*Assistant Examiner* — Gloryvid Figueroa-Gibson
(74) *Attorney, Agent, or Firm* — H.C. Park & Associates, PLC

(57) ABSTRACT

A method of driving a display panel includes outputting a gate signal to a gate line of the display panel in response to a first control signal and outputting a data voltage to a data line of the display panel in response to a second control signal using a plurality of data output blocks having driving timings different from one another. A single driving chip includes the plurality of data output blocks.

16 Claims, 12 Drawing Sheets

METHOD OF DRIVING DISPLAY PANEL AND DISPLAY APPARATUS FOR PERFORMING THE SAME

CLAIM OF PRIORITY

Priority is claimed under 35 U.S.C. §119 with respect to Korean Patent Application No. 10-2014-0063006, filed on May 26, 2014 in the Korean Intellectual Property Office KIPO, the contents of which are herein incorporated by reference in their entireties.

BACKGROUND OF THE INVENTION

Field of the Invention

The present invention relates to a method of driving a display panel and a display apparatus for performing the method. More particularly, the present invention relates to a method of driving a display panel so as to improve driving reliability and decrease a width of a bezel, and a display apparatus for performing the method.

Description of the Related Art

Generally, a liquid crystal display (LCD) apparatus comprises a first substrate including a pixel electrode, a second substrate including a common electrode, and a liquid crystal layer disposed between the first and second substrates. An electric field is generated by voltages applied to the pixel electrode and the common electrode. By adjusting an intensity of the electric field, transmittance of a light passing through the liquid crystal layer may be adjusted so that a desired image may be displayed.

Generally, a display apparatus includes a display panel and a panel driver. The display panel includes a plurality of gate lines and a plurality of data lines. The panel driver includes a gate driver providing gate signals to the gate lines and a data driver providing data voltages to the data lines.

To decrease the width of the bezel, a chip on glass (COG) method has been employed. In the COG method, a portion of the panel driver or an entire panel driver is mounted on a substrate of the display panel. As a resolution of the display panel increases, a level of an output current of the data driver increases. However, a positive power voltage of a logic voltage of the data driver tends to decrease.

When the data voltage is outputted from the data driver, a negative power voltage may momentarily increase. When a difference between the positive power voltage of the logic voltage and the negative power voltage of the data driver decreases, a level shifter in the data driver may be operated abnormally. Thus, driving reliability of the display apparatus may decrease.

In addition, when widths of wirings increase to prevent momentary increase of the negative power voltage when the data voltage is outputted, the width of the bezel may increase.

SUMMARY OF THE INVENTION

The present invention provides a method of driving a display panel so as to improve driving reliability while decreasing a width of a bezel.

The present invention also provides a display apparatus for performing the method of driving the display panel.

In an exemplary embodiment of the method of driving a display panel according to the present invention, the method includes outputting a gate signal to a gate line of the display panel in response to a first control signal and outputting a data voltage to a data line of the display panel in response to a second control signal using a plurality of data output blocks having driving timings different from one another. A single driving chip includes the plurality of data output blocks.

In an exemplary embodiment, when a distance of the data output block from a signal wiring transmitting a power voltage to the driving chip is relatively far, driving timing of the data output block may be relatively early.

In an exemplary embodiment, the driving chip may further include a control block configured to control the driving timings of the data output blocks.

In an exemplary embodiment, the outputting the voltage to the data line may use a plurality of driving chips. Each of the driving chips may include the plurality of data output blocks. All of the data output blocks of the driving chips may have driving timings different from one another.

In an exemplary embodiment, the outputting the voltage to the data line may use a plurality of driving chips. Each of the driving chips may include the plurality of data output blocks. First data output blocks of the driving chips may have a first driving timing and second data output blocks of the driving chips may have a second driving timing different from the first driving timing.

In an exemplary embodiment, the outputting the voltage to the data line may use a plurality of driving chips. When a resistance of a signal wiring transmitting a power voltage to the driving chip is relatively high, driving timing of the driving chip may be relatively early.

In an exemplary embodiment, the signal wiring may be sequentially connected to a first driving chip, a second driving chip adjacent to the first driving chip, a third driving chip adjacent to the second driving chip, and a fourth driving chip adjacent to the third driving chip.

In an exemplary embodiment, the fourth driving chip, the third driving chip, the second driving chip and the first driving chip may sequentially output the data voltage.

In an exemplary embodiment, a first signal wiring may be connected to a first driving chip, a second signal wiring is connected to a second driving chip, a third signal wiring is connected to a third driving chip, and a fourth signal wiring is connected to a fourth driving chip.

In an exemplary embodiment, the first and fourth driving chips corresponding to an edge portion of the display panel may output the data voltage earlier than the second and third driving chips corresponding to a central portion of the display panel.

In an exemplary embodiment, the driving chip may be mounted on a substrate on which the gate line and the data line are disposed.

In an exemplary embodiment of a display apparatus according to the present invention, the display apparatus includes a display panel, a timing controller, a gate driver and a data driver. The display panel includes a gate line and a data line. The display panel is configured to display an image. The timing controller is configured to generate a first control signal and a second control signal. The gate driver is configured to output a gate signal to the gate line in response to the first control signal. The data driver includes a driving chip mounted on a substrate on which the gate line and the data line are disposed, and including a plurality of data output blocks. The data output blocks have driving timings different from one another. The data driver is configured to output a data voltage to the data line using the data output blocks.

In an exemplary embodiment, when a distance of the data output block from a signal wiring transmitting a power voltage to the driving chip is relatively far, driving timing of the data output block may be relatively early.

In an exemplary embodiment, the driving chip may further include a control block configured to control the driving timings of the data output blocks.

In an exemplary embodiment, the data driver may include a plurality of driving chips. Each of the driving chips may include the plurality of data output blocks. All of the data output blocks of the driving chips may have driving timings different from one another.

In an exemplary embodiment, the data driver may include a plurality of driving chips. Each of the driving chips may include the plurality of data output blocks. First data output blocks of the driving chips may have a first driving timing and second data output blocks of the driving chips may have a second driving timing different from the first driving timing.

In an exemplary embodiment, the data driver may include a plurality of driving chips. The data driver may further include a signal wiring transmitting a power voltage to the driving chip and disposed on the substrate. When a resistance of the signal wiring connected to the driving chip is relatively high, driving timing of the driving chip may be relatively early.

According to the method of driving the display panel and the display apparatus for performing the method, the driving chip of the data driver includes a plurality of data output blocks and output timings of the data output blocks are adjusted so that an increase in a negative power source in the data driver is prevented. Thus, driving reliability of the display apparatus may be improved.

In addition, the negative power source in the data driver does not momentarily increase so that a thin and long wiring may be employed. Thus, the width of the bezel may decrease.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Hereinafter, the present invention will be explained in detail with reference to the accompanying drawings.

Figure 1:
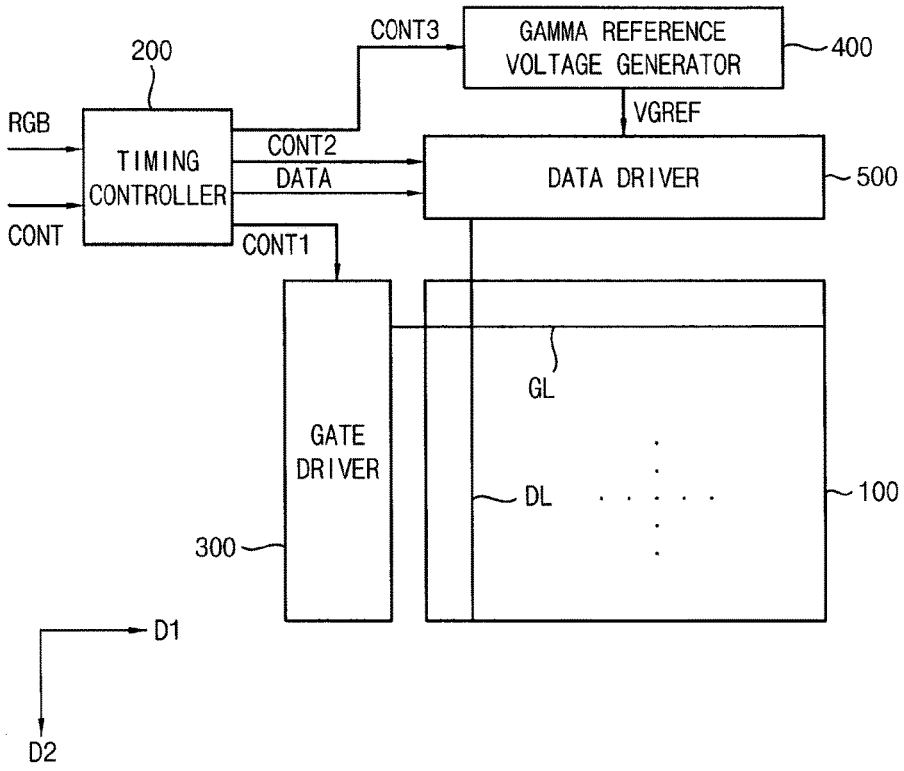
FIG. 1 is a block diagram illustrating a display apparatus according to an exemplary embodiment of the present invention.

FIG. 1 is a block diagram illustrating a display apparatus according to an exemplary embodiment of the present invention.

Referring to FIG. 1, the display apparatus includes a display panel 100 and a panel driver. The panel driver includes a timing controller 200, a gate driver 300, a gamma reference voltage generator 400 and a data driver 500.

The display panel 100 displays an image. The display panel 100 has a display region on which an image is displayed and a peripheral region adjacent to the display region.

The display panel 100 includes a plurality of gate lines GL, a plurality of data lines DL and a plurality of unit pixels connected to the gate lines GL and the data lines DL. The gate lines GL extend in a first direction D1 and the data lines DL extend in a second direction D2 crossing the first direction D1.

Each unit pixel includes a switching element (not shown), a liquid crystal capacitor (not shown) and a storage capacitor (not shown). The liquid crystal capacitor and the storage capacitor are electrically connected to the switching element. The unit pixels may be disposed in a matrix form.

The timing controller 200 receives input image data RGB and an input control signal CONT from an external apparatus (not shown). The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB1. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100, or it may be connected to the display panel 100 as a tape carrier package (TCP) type. Alternatively, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200 or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

In the present exemplary embodiment, the data driver 500 includes a plurality of driving chips. The driving chips are mounted on the display panel 100. For example, the driving chips may be mounted on a substrate on which the gate line GL and the data line DL are disposed.

Alternatively, the data driver 500 may be directly mounted on the display panel 100, or it may be connected to the display panel 100 as a TCP type. Alternatively, the data driver 500 may be integrated on the peripheral region of the display panel 100.

Figure 2:
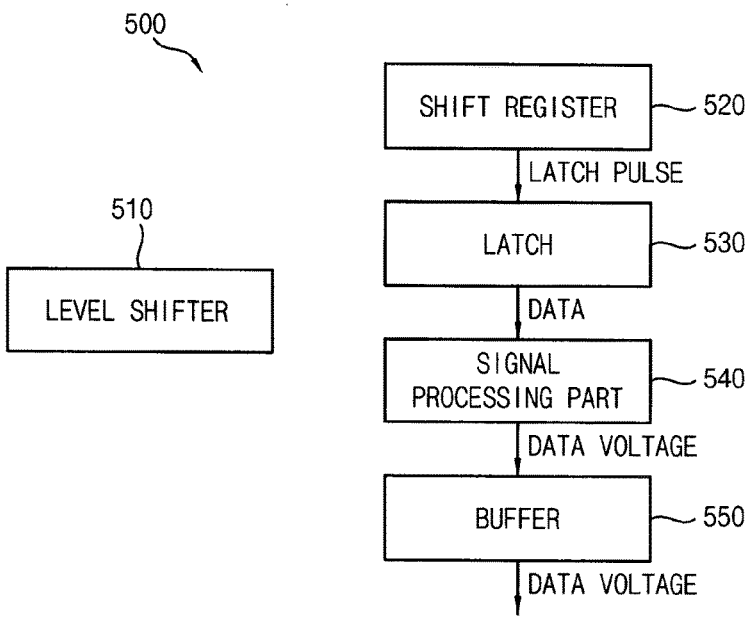
FIG. 2 is a block diagram illustrating a data driver of FIG. 1.
Figure 3:
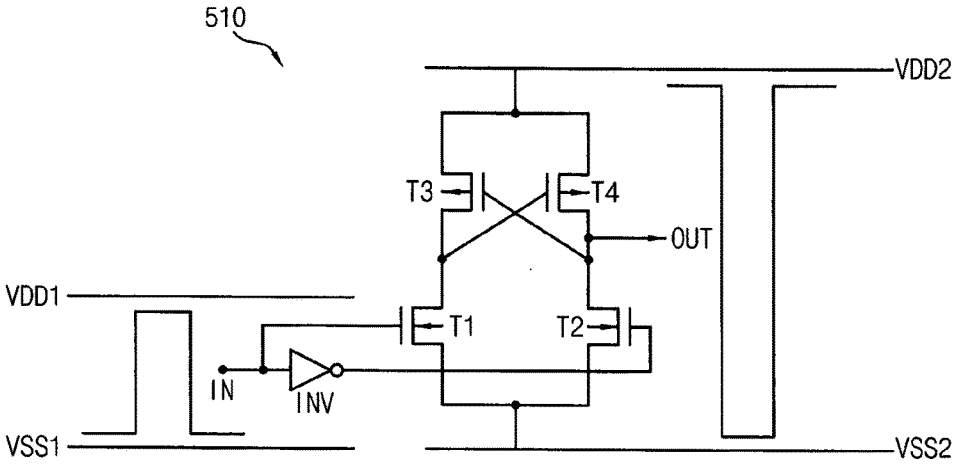
FIG. 3 is a circuit diagram illustrating a level shifter of FIG. 2.

FIG. 2 is a block diagram illustrating the data driver 500 of FIG. 1. FIG. 3 is a circuit diagram illustrating a level shifter of FIG. 2.

Referring to FIGS. 1 to 3, the data driver 500 includes a level shifter 510, a shift register 520, a latch 530, a signal processing part 540 and a buffer 550.

The level shifter 510 increases a level of an input voltage inputted to an input terminal IN so as to generate an output voltage. The level shifter 510 outputs the output voltage through an output terminal OUT.

For example, the input voltage has a value between a first positive power voltage VDD1 and a first negative power voltage VSS1. The output voltage has a value between a second positive power voltage VDD2 higher than the first positive power voltage VDD1 and a second negative power voltage VSS2.

The first positive power voltage VDD1 and the first negative power voltage VSS1 are mainly used with respect to a digital operation. For example, the first positive power voltage VDD1 may be called to a logic power, and the first negative power voltage VSS1 may be called to a logic ground. The second positive power voltage VDD2 and the second negative power voltage VSS2 may be used in the shift register 520 and the analog output buffer 550. For example, the first positive power voltage VDD1 may be between about 1V and about 2V, and the second positive power voltage VDD2 may be between about 7V and about 10V. For example, the first negative power voltage VSS1 may be a ground voltage, and the second negative power voltage VSS2 may be a ground voltage.

For example, a waveform of the output voltage may be inverted from the input voltage. As a further example, when the input voltage has a low level, the output voltage may have a high level and, when the input voltage has a high level, the output voltage may have a low level.

The level shifter 510 includes an inverter INV and first to fourth switching elements T1, T2, T3 and T4. A first end portion or input of the inverter INV is connected to the input terminal IN of the level shifter 510 and to a control electrode of the first switching element T1. A second end portion or output of the inverter INV is connected to a control electrode of the second switching element T2. An input electrode of the first switching element T1 is connected to a control electrode of the fourth switching element T4. The second negative power voltage VSS2 is applied to an output electrode of the first switching element T1. An input electrode of the second switching element T2 is connected to a control electrode of the third switching element T3. The second negative power voltage VSS2 is applied to an output electrode of the second switching element T2. The second positive power voltage VDD2 is applied to an input electrode of the third switching element T3. An output electrode of the third switching element T3 is connected to the input electrode of the first switching element T1. The second positive power voltage VDD2 is applied to an input electrode of the fourth switching element T4. An output electrode of the fourth switching element T4 is connected to the input electrode of the second switching element T2. The output terminal OUT of the level shifter 510 is connected to the output electrode of the fourth switching element T4.

The shift register 520 is a group of process registers of a linear type in a digital circuit. The shift register 520 outputs a latch pulse to the latch 530.

The latch 530 temporarily stores the data signal DATA and outputs the data signal DATA.

The signal processing part 540 converts the data signal DATA having a digital type to a data voltage having an analog type based on the gamma reference voltage VGREF and outputs the data voltage. The signal processing part 540 may include a digital to analog converter.

The buffer 550 buffers the data voltage outputted from the signal processing part 540 and outputs the data voltage to the data line DL. The buffer 550 may include an amplifier connected to the data line DL.

Figure 4:
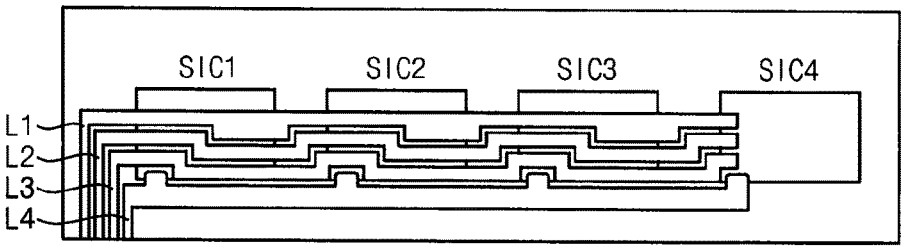
FIG. 4 is a plan view illustrating a driving chip and a wiring of the data driver of FIG. 1.
Figure 5A:
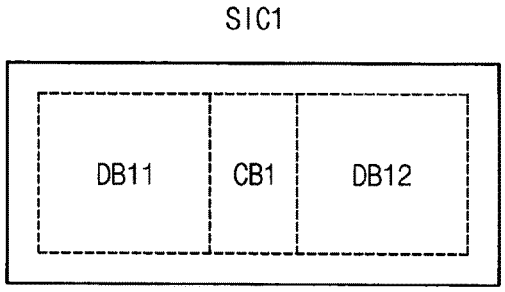
FIG. 5A is a block diagram illustrating a first driving chip of FIG. 4.
Figure 5B:
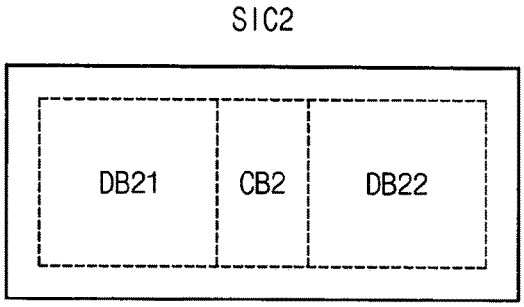
FIG. 5B is a block diagram illustrating a second driving chip of FIG. 4.
Figure 5C:
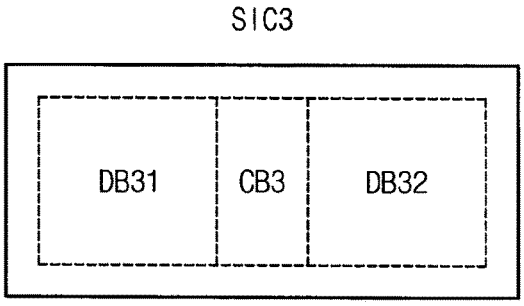
FIG. 5C is a block diagram illustrating a third driving chip of FIG. 4.
Figure 5D:
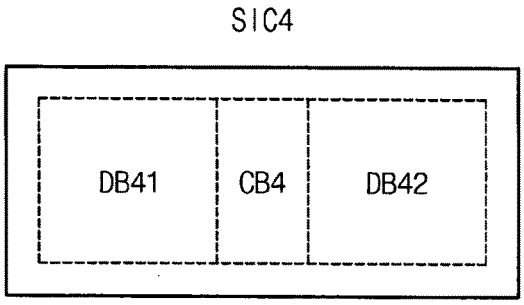
FIG. 5D is a block diagram illustrating a fourth driving chip of FIG. 4.
Figure 6:
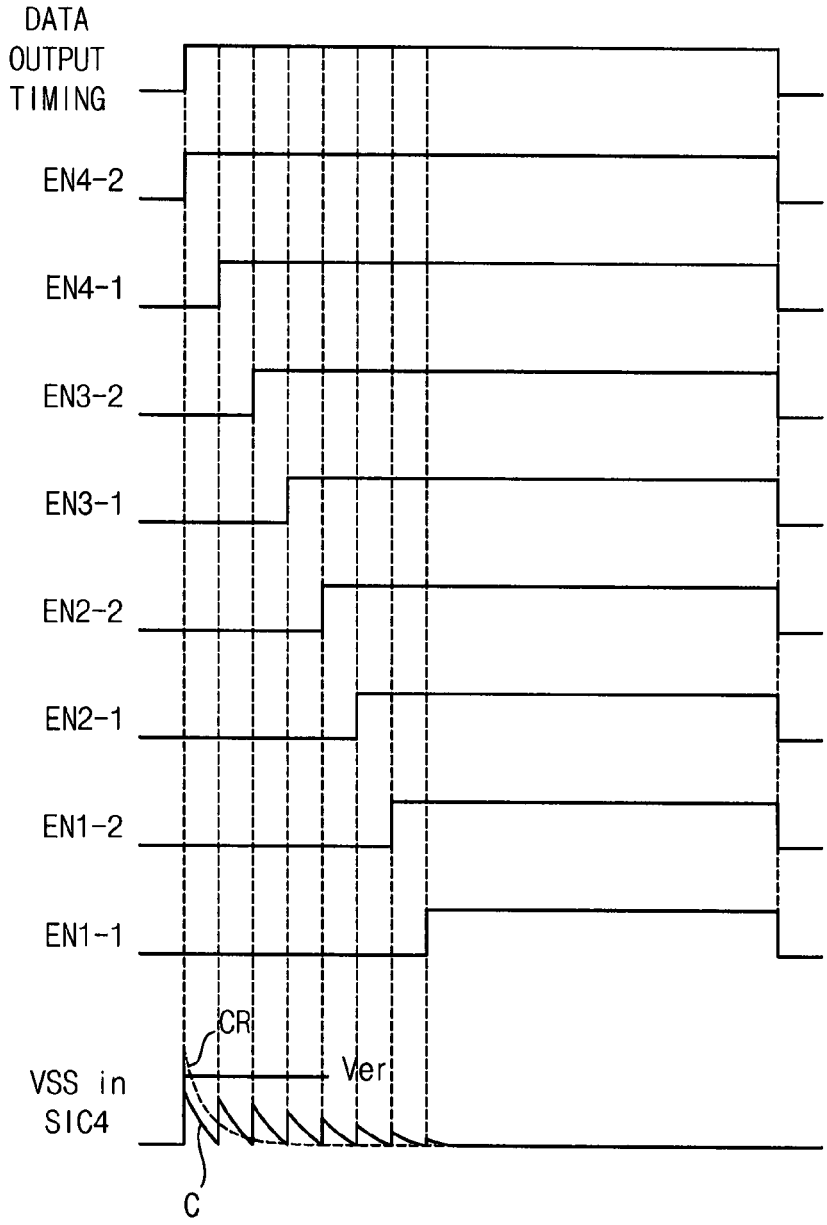
FIG. 6 is a waveform diagram illustrating signals in the data driver of FIG. 1.

FIG. 4 is a plan view illustrating a driving chip and a wiring of the data driver 500 of FIG. 1. FIG. 5A is a block diagram illustrating a first driving chip of FIG. 4. FIG. 5B is a block diagram illustrating a second driving chip of FIG. 4. FIG. 5C is a block diagram illustrating a third driving chip of FIG. 4. FIG. 5D is a block diagram illustrating a fourth driving chip of FIG. 4. FIG. 6 is a waveform diagram illustrating signals in the data driver 500 of FIG. 1.

Referring to FIGS. 1 to 6, the data driver 500 includes a driving chip. For example, the data driver 500 may include a plurality of driving chips, and the data driver 500 may include four driving chips SIC1, SIC2, SIC3 and SIC4. The data driver 500 includes a first driving chip SIC1, a second driving chip SIC2 adjacent to the first driving chip SIC1, a third driving chip SIC3 adjacent to the second driving chip SIC2 and a fourth driving chip SIC4 adjacent to the third driving chip SIC3.

Each driving chip includes a plurality of data output blocks. The first driving chip SIC1 includes a first data output block DB11 and a second data output block DB12. The second driving chip SIC2 includes a first data output block DB21 and a second data output block DB22. The third driving chip SIC3 includes a first data output block DB31 and a second data output block DB32. The fourth driving chip SIC4 includes a first data output block DB41 and a second data output block DB42.

Each driving chip may further include a control block. The first driving chip SIC1 may further include a first control block CB1. The second driving chip SIC2 may further include a second control block CB2. The third driving chip SIC3 may further include a third control block CB3. The fourth driving chip SIC4 may further include a fourth control block CB4. The control block receives the second control signal CONT2 from the timing controller 200 so as to control an operation of the driving chip. For example, the control block may control output timings of the data output blocks.

Although the data driver 500 includes four driving chips in the present exemplary embodiment, the present invention is not limited to the number of driving chips. Alternatively, the data driver 500 may include a single driving chip.

Although each driving chip includes two data output blocks in the present exemplary embodiment, the present invention is not limited to the number of data output blocks. However, in the present exemplary embodiment, the data driver 500 includes at least one driving chip, which includes a plurality of data output blocks.

The data driver 500 includes signal wirings L1, L2, L3 and L4 for transmitting a power voltage to the driving chips SIC1, SIC2, SIC3 and SIC4, respectively. In the present exemplary embodiment, the signal wirings L1, L2, L3 and L4 may be sequentially connected to the first driving chip SIC1, the second driving chip SIC2, the third driving chip SIC3 and the fourth driving chip SIC4.

For example, a first signal wiring L1 may transmit the second positive power voltage VDD2 to the first to fourth driving chips SIC1, SIC2, SIC3 and SIC4. A second signal wiring L2 may transmit the first positive power voltage VDD1 to the first to fourth driving chips SIC1, SIC2, SIC3 and SIC4. A third signal wiring L3 may transmit the first negative power voltage VSS1 to the first to fourth driving chips SIC1, SIC2, SIC3 and SIC4. A fourth signal wiring L4 may transmit the second negative power voltage VSS2 to the first to fourth driving chips SIC1, SIC2, SIC3 and SIC4.

The first driving chip SIC1 is relatively close to a power providing part (not shown). The fourth driving chip SIC4 is relatively far from the power providing part (not shown). Thus, the resistance of a portion of the signal wiring connected to the fourth driving chip SIC4 is higher than the resistance of a portion of the signal wiring connected to the first driving chip SIC1.

In FIG. 6, EN1-1 is an enable signal of the first data output block DB11 of the first driving chip SIC1 representing driving timing of the first data output block DB11 of the first driving chip SIC1 which outputs the data voltage. EN1-2 is an enable signal of the second data output block DB12 of the first driving chip SIC1 representing driving timing of the second data output block DB12 of the first driving chip SIC1 which outputs the data voltage. EN2-1 is an enable signal of the first data output block DB21 of the second driving chip SIC2 representing driving timing of the first data output block DB21 of the second driving chip SIC2 which outputs the data voltage. EN2-2 is an enable signal of the second data output block DB22 of the second driving chip SIC2 representing driving timing of the second data output block DB22 of the second driving chip SIC2 which outputs the data voltage. EN3-1 is an enable signal of the first data output block DB31 of the third driving chip SIC3 representing driving timing of the first data output block DB31 of the third driving chip SIC3 which outputs the data voltage. EN3-2 is an enable signal of the second data output block DB32 of the third driving chip SIC3 representing driving timing of the second data output block DB32 of the third driving chip SIC3 which outputs the data voltage. EN4-1 is an enable signal of the first data output block DB41 of the fourth driving chip SIC4 representing driving timing of the first data output block DB41 of the fourth driving chip SIC4 which outputs the data voltage. EN4-2 is an enable signal of the second data output block DB42 of the fourth driving chip SIC4 representing driving timing of the second data output block DB42 of the fourth driving chip SIC4 which outputs the data voltage.

In the present exemplary embodiment, the first data output block DB11 and the second data output block DB12 of the first driving chip SIC1 have driving timings different from each other. The first data output block DB21 and the second data output block DB22 of the second driving chip SIC2 have driving timings different from each other. The first data output block DB31 and the second data output block DB32 of the third driving chip SIC3 have driving timings different from each other. The first data output block DB41 and the second data output block DB42 of the fourth driving chip SIC4 have driving timings different from each other. In addition, the first to fourth driving chips SIC1 to SIC4 have driving timings different from one another. Therefore, all of the eight data output blocks DB11 to DB42 of the first to fourth driving chips SIC1 to SIC4 may have driving timings different from one another.

In the present exemplary embodiment, when a distance of the driving chip from the signal wiring L1 to L4 transmitting the power voltage to the driving chip SIC1, SIC2, SIC3 and SIC4 is relatively far, driving timing of the driving chip SIC1, SIC2, SIC3 and SIC4 is designed to be relatively early. For example, when the second data output blocks DB12, DB22, DB32 and DB42 are far from the signal wirings L1 to L4 compared to the first data output blocks DB11, DB21, DB31 and DB41, driving timing of the second output block DB12, DB22, DB32 and DB42 is earlier than driving timing of the first output block DB11, DB21, DB31 and DB41 respectively in the driving chip SIC1, SIC2, SIC3 and SIC4.

In the present exemplary embodiment, when a resistance of the signal wiring (e.g. L1) transmitting the power voltage to the driving chip SIC1, SIC2, SIC3 and SIC4 is relatively high, driving timing of the driving chip SIC1, SIC2, SIC3 and SIC4 is relatively early. For example, the fourth driving chip SIC4, the third driving chip SIC3, the second driving chip SIC2 and the first driving chip SIC1 sequentially output the data voltage.

The CR curve in FIG. 6 represents a waveform of the second negative power voltage VSS2 of the fourth driving chip SIC4 in a conventional driving method in which the driving chip is not divided into the plurality of data output blocks and the driving chips concurrently output the data voltage. In the conventional driving method, the first to fourth driving chips SIC1 to SIC4 concurrently output the data voltage so that a noise is generated due to a resistance of the signal wiring. Accordingly, the second negative power voltage VSS2 of the fourth driving chip SIC4 momentarily increases. The fourth driving chip SIC4 is the farthest from the power providing part so that a resistance of a portion of the signal wiring connected to the fourth driving chip SIC4 is the highest and the second negative power voltage VSS2 of the fourth driving chip SIC4 increases the most.

In FIG. 6, Ver is an error reference voltage of abnormal operation of the level shifter 510 and the shift register 520 due to the second negative power voltage VSS2. When the second negative power voltage VSS2 exceeds the error reference voltage Ver, the level shifter 510 and the shift register 520 may operate abnormally.

Referring again to FIG. 3, when the second negative power voltage VSS2 exceeds the error reference voltage Ver, the level of the second power voltage VSS2 connected to the output electrodes of the first and second switching elements T1 and T2, respectively, the first and second switching elements T1 and T2, respectively, may not be normally turned on. Thus, the level shifter 510 operates abnormally and the shift register 520 and the buffer 550 may operate abnormally.

According to the principles of the present invention, the first and second data output blocks DB11 to DB42, respectively, of the first to fourth driving chips SIC1, SIC2, SIC3 and SIC4, respectively, of the present exemplary embodiment are controlled to have driving timings different from one another. In FIG. 6, the C curve represents a waveform of the second negative power voltage VSS2 of the fourth driving chip SIC4 according to the present invention.

For example, a first rising waveform of the C curve is a waveform of the second negative power voltage VSS2 of the fourth driving chip SIC4 when the second data output block DB42 of the fourth driving chip SIC4 outputs the data voltage. A second rising waveform of the C curve is a waveform of the second negative power voltage VSS2 of the fourth driving chip SIC4 when the first data output block DB41 of the fourth driving chip SIC4 outputs the data voltage. A third rising waveform of the C curve is a waveform of the second negative power voltage VSS2 of the third driving chip SIC3 when the second data output block DB32 of the third driving chip SIC3 outputs the data voltage. A fourth rising waveform of the C curve is a waveform of the second negative power voltage VSS2 of the third driving chip SIC3 when the first data output block DB31 of the third driving chip SIC3 outputs the data voltage. A fifth rising waveform of the C curve is a waveform of the second negative power voltage VSS2 of the second driving chip SIC2 when the second data output block DB22 of the second driving chip SIC2 outputs the data voltage. A sixth rising waveform of the C curve is a waveform of the second negative power voltage VSS2 of the second driving chip SIC2 when the first data output block DB21 of the second driving chip SIC2 outputs the data voltage. A seventh rising waveform of the C curve is a waveform of the second negative power voltage VSS2 of the first driving chip SIC1 when the second data output block DB12 of the first driving chip SIC1 outputs the data voltage. An eighth rising waveform of the C curve is a waveform of the second negative power voltage VSS2 of the first driving chip SIC1 when the first data output block DB11 of the first driving chip SIC1 outputs the data voltage.

As shown in FIG. 6, the first and second data output blocks DB11 to DB42 of the first to fourth driving chips SIC1, SIC2, SIC3 and SIC4 have driving timings different from one another so that the second negative power voltage VSS2 does not exceed the error reference voltage Ver. Thus, the level shifter 510 and the shift register 520 operate normally.

In an exemplary embodiment, the control blocks CB1 to CB4 of the driving chips SIC1, SIC2, SIC3 and SIC4 may control their own driving timings so as to be different from one another. The driving chips SIC1, SIC2, SIC3 and SIC4 may store their own addresses. According to the addresses, the driving chips SIC1, SIC2, SIC3 and SIC4 may set the driving timings of the driving chips SIC1, SIC2, SIC3 and SIC4. The driving chips SIC1, SIC2, SIC3 and SIC4 receive a driving chip control signal from the timing controller 200. The driving chips SIC1, SIC2, SIC3 and SIC4 generate the first to eighth driving enable signals EN1-1 to EN4-2 based on the driving chip control signal.

Alternatively, the timing controller 200 may generate a plurality of driving chip control signals and outputs the driving chip control signals to the data driver 500 so that the driving chips SIC1, SIC2, SIC3 and SIC4 have different driving timings. The timing controller 200 may output the driving chip control signals having timings different from one another to the driving chips SIC1, SIC2, SIC3 and SIC4.

In an exemplary embodiment, when the driving timing of the driving chip is relatively late, a bias current of the driving chip may be relatively high. When the driving timing of the driving chip is relatively late, a charging time of a pixel connected to the driving chip may be relatively short. The bias current of the driving chip having a relatively short charging time increases so that driving ability of the driving chip may be improved and a decrease in the charging time of the driving chip may be compensated.

For example, a bias current of a buffer of the first driving chip SIC1 may be the highest. A bias current of a buffer of the fourth driving chip SIC4 may be the lowest.

According to the present exemplary embodiment, the plurality of the data output blocks DB11 to DB42 of the driving chips SIC1, SIC2, SIC3 and SIC4 have driving timings different from one another so that the second negative power voltage VSS2 in the signal wiring is prevented from exceeding the error reference voltage Ver. Thus, driving reliability may be improved.

In addition, when the plurality of the data output blocks of the driving chips SIC1, SIC2, SIC3 and SIC4 have driving timings different from one another, the second negative power voltage VSS2 in the signal wiring does not momentarily increase, allowing one to design the signal wiring to have a higher resistance. For example, when a thin and long signal wiring is employed, a width of a bezel of the display apparatus may decrease.

Figure 7:
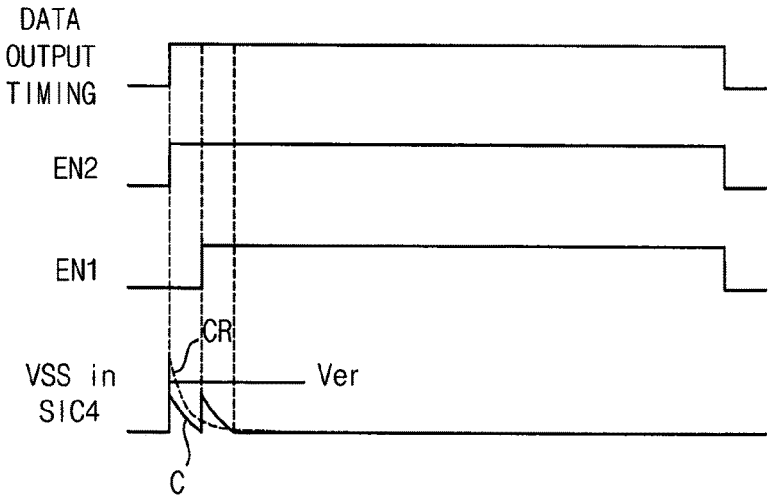
FIG. 7 is a waveform diagram illustrating signals in a data driver according to an exemplary embodiment of the present invention.

FIG. 7 is a waveform diagram illustrating signals in the data driver 500 according to an exemplary embodiment of the present invention.

The method of driving the display panel and the display apparatus for performing the method are substantially the same as the method of driving the display panel and the display apparatus for performing the method of the previous exemplary embodiment explained referring to FIGS. 1 to 6 except for the driving timing of the data output blocks of the driving chips. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 5D and 7, the display apparatus includes a display panel 100 and a panel driver. The panel driver includes a timing controller 200, a gate driver 300, a gamma reference voltage generator 400 and a data driver 500.

The data driver 500 includes a driving chip. For example, the data driver 500 may include a plurality of driving chips, and the data driver may include four driving chips SIC1, SIC2, SIC3 and SIC4. The data driver 500 includes a first driving chip SIC1, a second driving chip SIC2 adjacent to the first driving chip SIC1, a third driving chip SIC3 adjacent to the second driving chip SIC2 and a fourth driving chip SIC4 adjacent to the third driving chip SIC3.

The driving chip includes a plurality of data output blocks. The first driving chip SIC1 includes a first data output block DB11 and a second data output block DB12. The second driving chip SIC2 includes a first data output block DB21 and a second data output block DB22. The third driving chip SIC3 includes a first data output block DB31 and a second data output block DB32. The fourth driving chip SIC4 includes a first data output block DB41 and a second data output block DB42.

The driving chip may further include a control block. The first driving chip SIC1 may further include a first control block CB1. The second driving chip SIC2 may further include a second control block CB2. The third driving chip SIC3 may further include a third control block CB3. The fourth driving chip SIC4 may further include a fourth control block CB4. Each control block receives the second control signal CONT2 from the timing controller 200 so as to control an operation of the driving chip. For example, the control block may control output timings of the data output blocks.

The data driver 500 includes signal wirings L1, L2, L3 and L4 for transmitting a power voltage to the driving chips SIC1, SIC2, SIC3 and SIC4. In the present exemplary embodiment, the signal wirings L1, L2, L3 and L4 may be sequentially connected to the first driving chip SIC1, the second driving chip SIC2, the third driving chip SIC3 and the fourth driving chip SIC4.

In FIG. 7, EN1 is an enable signal of the first data output blocks DB11, DB21, DB31 and DB41 of the first to fourth driving chips SIC1 to SIC4 representing driving timing of the first data output blocks DB11, DB21, DB31 and DB41 of the first to fourth driving chips SIC1 to SIC4 which output the data voltage. EN2 is an enable signal of the second data output blocks DB12, DB22, DB32 and DB42 of the first to fourth driving chips SIC1 to SIC4 representing driving timing of the second data output block DB12, DB22, DB32 and DB42 of the first to fourth driving chips SIC1 to SIC4 which output the data voltage.

In the present exemplary embodiment, the first data output block DB11 and the second data output block DB12 of the first driving chip SIC1 have driving timings different from each other. The first data output block DB21 and the second data output block DB22 of the second driving chip SIC2 have driving timings different from each other. The first data output block DB31 and the second data output block DB32 of the third driving chip SIC3 have driving timings different from each other. The first data output block DB41 and the second data output block DB42 of the fourth driving chip SIC4 have driving timings different from each other. The first to fourth driving chips SIC1 to SIC4 have the same driving timings as one another. Therefore, the first data output blocks DB11, DB21, DB31 and DB41 of the driving chips SIC1 to SIC4 commonly have a first driving timing. The second data output blocks DB12, DB22, DB32 and DB42 of the driving chips SIC1 to SIC4 commonly have a second driving timing.

In the present exemplary embodiment, when a distance of the driving chip from the signal wiring L1 to L4 transmitting the power voltage to the driving chip SIC1, SIC2, SIC3 and SIC4 is relatively far, driving timing of the driving chip SIC1, SIC2, SIC3 and SIC4 is relatively early. For example, when the second data output blocks DB12, DB22, DB32 and DB42 are far from the signal wirings L1 to L4 compared to the first data output blocks DB11, DB21, DB31 and DB41, driving timing of the second output block DB12, DB22, DB32 and DB42 is earlier than driving timing of the first output block DB11, DB21, DB31 and DB41 in the driving chip SIC1, SIC2, SIC3 and SIC4.

In the present exemplary embodiment, the first data output blocks DB11, DB21, DB31 and DB41 of the first to fourth driving chips SIC1, SIC2, SIC3 and SIC4 and the second data output blocks DB12, DB22, DB32 and DB42 of the first to fourth driving chips SIC1, SIC2, SIC3 and SIC4 are controlled so as to have driving timings different from each other. In FIG. 6, the C curve represents a waveform of the second negative power voltage VSS2 of the fourth driving chip SIC4.

For example, a first rising waveform of the C curve is a waveform of the second negative power voltage VSS2 of the fourth driving chip SIC4 when the second data output blocks DB12, DB22, DB32 and DB42 of the first to fourth driving chips SIC1 to SIC4 output the data voltage. A second rising waveform of the C curve is a waveform of the second negative power voltage VSS2 of the fourth driving chip SIC4 when the first data output blocks DB11, DB21, DB31 and DB41 of the first to fourth driving chips SIC1 to SIC4 output the data voltage.

As shown in FIG. 7, the first data output blocks DB11, DB21, DB31 and DB41 of the first to fourth driving chips SIC1, SIC2, SIC3 and SIC4 have a driving timing different from the driving timing of the second data output blocks DB12, DB22, DB32 and DB42 of the first to fourth driving chips SIC1, SIC2, SIC3 and SIC4 so that the second negative power voltage VSS2 does not exceed the error reference voltage Ver. Thus, the level shifter 510 and the shift register 520 operate normally.

According to the present exemplary embodiment, the first data output blocks DB11, DB21, DB31 and DB41 of the driving chips have driving timing different from driving timing of the second data output blocks DB12, DB22, DB32 and DB41 of the driving chips so that the second negative power voltage VSS2 in the signal wiring is prevented from exceeding the error reference voltage Ver. Thus, driving reliability may be improved.

In addition, when the first data output blocks DB11, DB21, DB31 and DB41 of the driving chips SIC1, SIC2, SIC3 and SIC4 and the second data output blocks DB12, DB22, DB32 and DB42 of the driving chips SIC1, SIC2, SIC3 and SIC4 have driving timings different from each other, the second negative power voltage VSS2 in the signal wiring does not momentarily increase so that a relatively high resistance of the signal wiring is allowed. For example, when a thin and long signal wiring is employed, the width of a bezel of the display apparatus may decrease.

Figure 8:
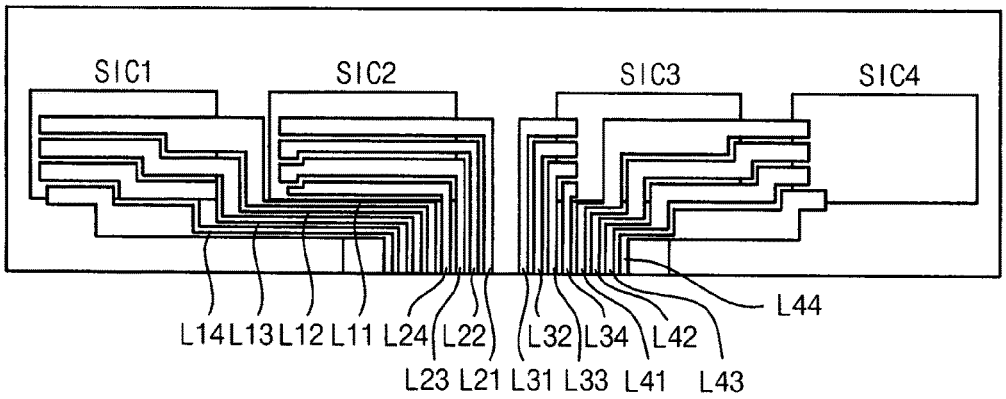
FIG. 8 is a plan view illustrating a driving chip and a wiring of a data driver according to an exemplary embodiment of the present invention.
Figure 9A:
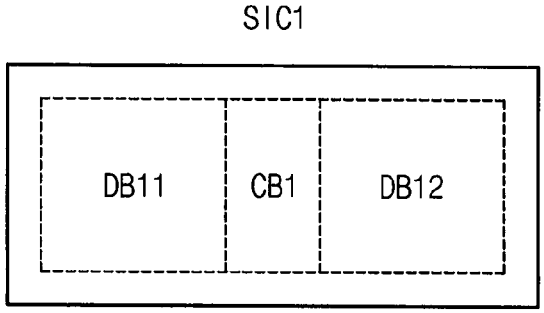
FIG. 9A is a block diagram illustrating a first driving chip of FIG. 8.
Figure 9B:
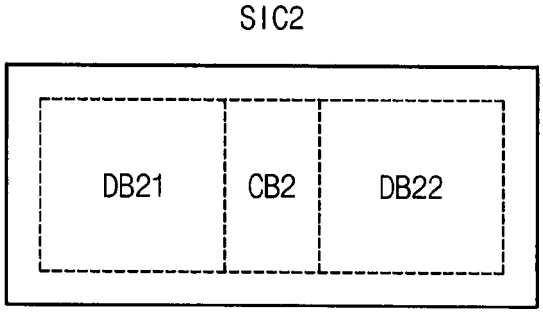
FIG. 9B is a block diagram illustrating a second driving chip of FIG. 8.
Figure 9C:
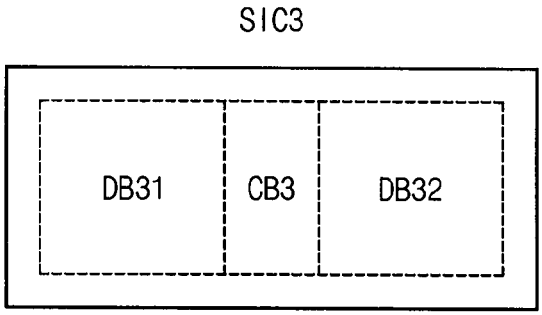
FIG. 9C is a block diagram illustrating a third driving chip of FIG. 8.
Figure 9D:
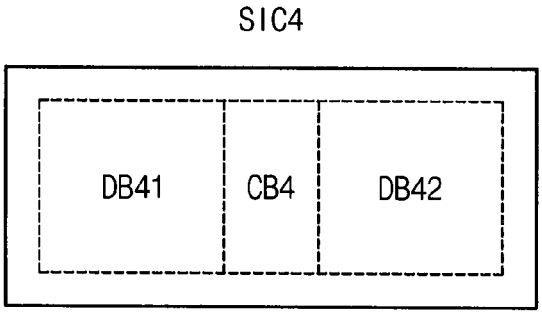
FIG. 9D is a block diagram illustrating a fourth driving chip of FIG. 8.
Figure 10:
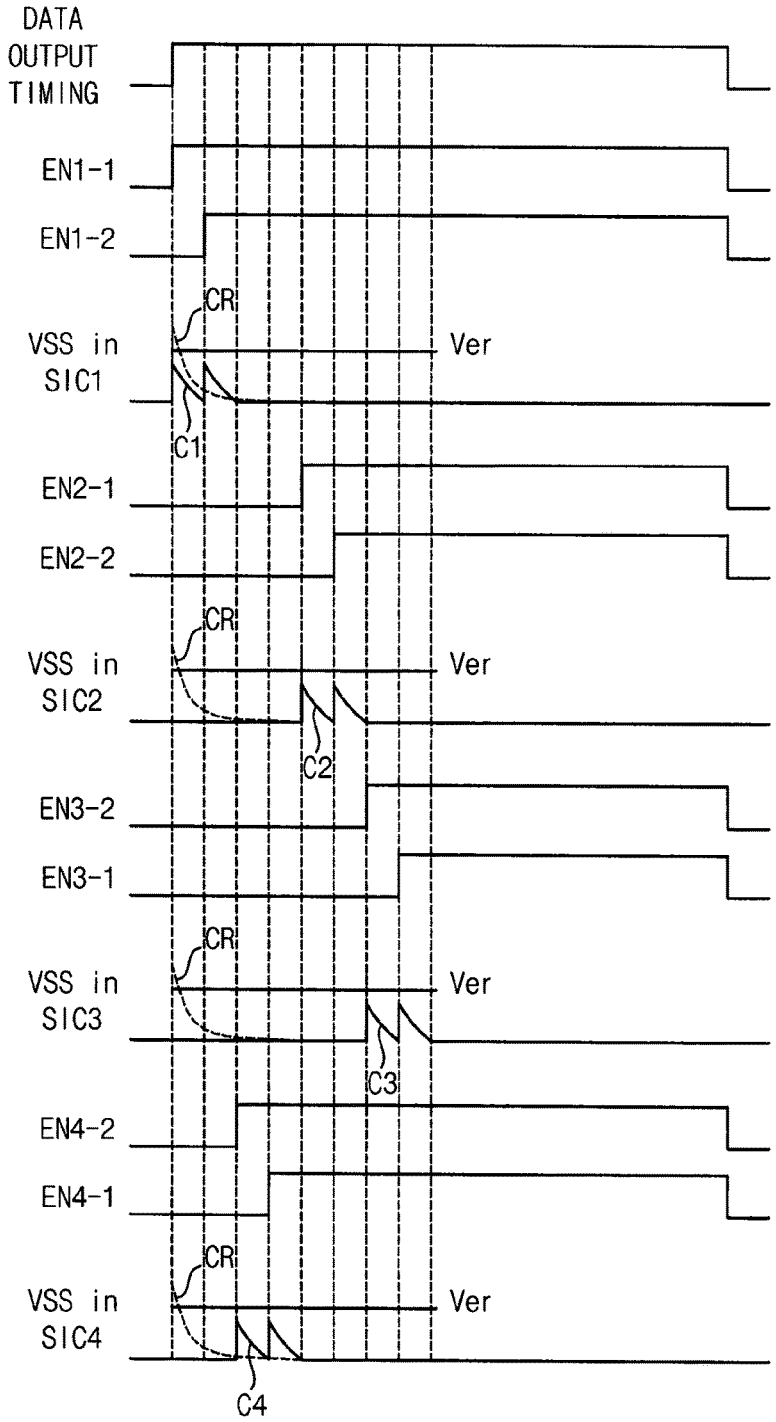
FIG. 10 is a waveform diagram illustrating signals in the data driver of FIG. 8.

FIG. 8 is a plan view illustrating a driving chip and a wiring of a data driver according to an exemplary embodiment of the present invention. FIG. 9A is a block diagram illustrating a first driving chip of FIG. 8. FIG. 9B is a block diagram illustrating a second driving chip of FIG. 8. FIG. 9C is a block diagram illustrating a third driving chip of FIG. 8. FIG. 9D is a block diagram illustrating a fourth driving chip of FIG. 8. FIG. 10 is a waveform diagram illustrating signals in the data driver of FIG. 8.

The method of driving the display panel and the display apparatus for performing the method are substantially the same as the method of driving the display panel and the display apparatus for performing the method of the previous exemplary embodiment explained referring to FIGS. 1 to 6 except for a wiring structure connecting the driving chips. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 3 and 8 to 10, the display apparatus includes a display panel 100 and a panel driver. The panel driver includes a timing controller 200, a gate driver 300, a gamma reference voltage generator 400 and a data driver 500.

The data driver 500 includes a driving chip. For example, the data driver 500 may include a plurality of driving chips, and the data driver may include four driving chips SIC1, SIC2, SIC3 and SIC4. The data driver 500 includes a first driving chip SIC1, a second driving chip SIC2 adjacent to the first driving chip SIC1, a third driving chip SIC3 adjacent to the second driving chip SIC2, and a fourth driving chip SIC4 adjacent to the third driving chip SIC3.

Each driving chip includes a plurality of data output blocks. The first driving chip SIC1 includes a first data output block DB11 and a second data output block DB12. The second driving chip SIC2 includes a first data output block DB21 and a second data output block DB22. The third driving chip SIC3 includes a first data output block DB31 and a second data output block DB32. The fourth driving chip SIC4 includes a first data output block DB41 and a second data output block DB42.

Each driving chip may further include a control block. The first driving chip SIC1 may further include a first control block CB1. The second driving chip SIC2 may further include a second control block CB2. The third driving chip SIC3 may further include a third control block CB3. The fourth driving chip SIC4 may further include a fourth control block CB4. The control block receives the second control signal CONT2 from the timing controller 200 so as to control an operation of the driving chip. For example, the control block may control output timings of the data output blocks.

The data driver 500 includes signal wirings L11 to L44 for transmitting a power voltage to the driving chips SIC1, SIC2, SIC3 and SIC4, respectively. In the present exemplary embodiment, a first group of the signal wirings L11 to L14 may be connected to the first driving chip SIC1. A second group of the signal wirings L21 to L24 may be connected to the second driving chip SIC2. A third group of the signal wirings L31 to L34 may be connected to the third driving chip SIC3. A fourth group of the signal wirings L41 to L44 may be connected to the fourth driving chip SIC4.

For example, first signal wirings L11, L21, L31 and L41 in each group may transmit a second positive power voltage VDD2 to the first to fourth driving chips SIC1, SIC2, SIC3 and SIC4. Second signal wirings L12, L22, L32 and L42 may transmit a first positive power voltage VDD1 to the first to fourth driving chips SIC1, SIC2, SIC3 and SIC4. Third signal wirings L13, L23, L33 and L43 may transmit a first negative power voltage VSS1 to the first to fourth driving chips SIC1, SIC2, SIC3 and SIC4. Fourth signal wirings L14, L24, L34 and L44 may transmit a second negative power voltage VSS2 to the first to fourth driving chips SIC1, SIC2, SIC3 and SIC4.

The first driving chip SIC1 and the fourth driving chip SIC4 corresponding to an edge portion of the display panel 100 are relatively far from a power providing part (not shown). The second driving chip SIC2 and the third driving chip SIC3 corresponding to a central portion of the display panel 100 are relatively close to the power providing part (not shown). Thus, resistances of portions of the signal wirings connected to the first and fourth driving chips SIC1 and SIC4, respectively, are higher than resistances of portions of the signal wirings connected to the second and third driving chips SIC2 and SIC3, respectively. For example, the signal wirings in the present exemplary embodiment extend to a left portion of the driving chips SIC1, SIC2, SIC3 and SIC4. A resistance of a portion of the signal wiring connected to the first driving chip SIC1 is higher than a resistance of a portion of the signal wiring connected to the fourth driving chip SIC4. A resistance of a portion of the signal wiring connected to the second driving chip SIC2 is higher than a resistance of a portion of the signal wiring connected to the third driving chip SIC3.

In FIG. 10, EN1-1 is an enable signal of the first data output block DB11 of the first driving chip SIC1 representing driving timing of the first data output block DB11 of the first driving chip SIC1 which outputs the data voltage. EN1-2 is an enable signal of the second data output block DB12 of the first driving chip SIC1 representing driving timing of the second data output block DB12 of the first driving chip SIC1 which outputs the data voltage. EN2-1 is an enable signal of the first data output block DB21 of the second driving chip SIC2 representing driving timing of the first data output block DB21 of the second driving chip SIC2 which outputs the data voltage. EN2-2 is an enable signal of the second data output block DB22 of the second driving chip SIC2 representing driving timing of the second data output block DB22 of the second driving chip SIC2 which outputs the data voltage. EN3-1 is an enable signal of the first data output block DB31 of the third driving chip SIC3 representing driving timing of the first data output block DB31 of the third driving chip SIC3 which outputs the data voltage. EN3-2 is an enable signal of the second data output block DB32 of the third driving chip SIC3 representing driving timing of the second data output block DB32 of the third driving chip SIC3 which outputs the data voltage. EN4-1 is an enable signal of the first data output block DB41 of the fourth driving chip SIC4 representing driving timing of the first data output block DB41 of the fourth driving chip SIC4 which outputs the data voltage. EN4-2 is an enable signal of the second data output block DB42 of the fourth driving chip SIC4 representing driving timing of the second data output block DB42 of the fourth driving chip SIC4 which outputs the data voltage.

In the present exemplary embodiment, the first data output block DB11 and the second data output block DB12 of the first driving chip SIC1 have driving timings different from each other. The first data output block DB21 and the second data output block DB22 of the second driving chip SIC2 have driving timings different from each other. The first data output block DB31 and the second data output block DB32 of the third driving chip SIC3 have driving timings different from each other. The first data output block DB41 and the second data output block DB42 of the fourth driving chip SIC4 have driving timings different from each other. In addition, the first to fourth driving chips SIC1 to SIC4 have driving timings different from one another. Therefore, all of the eight data output blocks DB11 to DB42 of the first to fourth driving chips SIC1 to SIC4 may have driving timings different from one another.

In the present exemplary embodiment, when a distance of the driving chip from the power providing part signal wiring L1 to L4 transmitting the power voltage to the driving chips SIC1, SIC2, SIC3 and SIC4 is relatively far, the driving timing of the driving chips SIC1, SIC2, SIC3 and SIC4 is relatively early. For example, when the second data output blocks DB32 and DB42 are far from the signal wirings L31 to L44 compared to the first data output blocks DB31 and DB41 in the third and fourth driving chips SIC3 and SIC4, driving timings of the second output blocks DB32 and DB42 are respectively earlier than driving timings of the first output blocks DB31 and DB41. For example, when the first data output blocks DB11 and DB21 are far from the signal wirings L11 to L24 compared to the second data output blocks DB12 and DB22 in the first and second driving chips SIC1 and SIC2, driving timings of the first output blocks DB11 and DB21 are respectively earlier than driving timings of the second output blocks DB12 and DB22.

In the present exemplary embodiment, when a resistance of the signal wiring transmitting the power voltage to the driving chip SIC1, SIC2, SIC3 and SIC4 is relatively high, driving timing of the driving chip SIC1, SIC2, SIC3 and SIC4 is relatively early. For example, the first driving chip SIC1, the fourth driving chip SIC4, the second driving chip SIC2 and the third driving chip SIC3 sequentially output the data voltage.

Alternatively, the first driving chip SIC1 and the fourth driving chip SIC4 output the data voltage with a first timing and the second driving chip SIC2 and the third driving chip SIC3 output the data voltage with a second timing.

In FIG. 10, the CR curve represents a waveform of the second negative power voltage VSS2 of the fourth driving chip SIC4 in a conventional driving method in which the driving chip is not divided into the plurality of the data output blocks, and the driving chips concurrently output the data voltage. In the conventional driving method, the first to fourth driving chips SIC1 to SIC4, respectively, concurrently output the data voltage so that a noise is generated due to a resistance of the signal wiring.

Referring again to FIG. 3, when the second negative power voltage VSS2 exceeds an error reference voltage Ver, the level of the second power voltage VSS2 connected to the output electrodes of the first and second switching elements T1 and T2, the first and second switching elements T1 and T2 may not be normally turned on. Thus, the level shifter 510 operates abnormally and the shift register 520 and the buffer 550 may operate abnormally.

The first and second data output blocks DB11 to DB42 of the first to fourth driving chips SIC1, SIC2, SIC3 and SIC4 of the present exemplary embodiment are controlled to have driving timings different from one another. In FIG. 10, the C1 curve represents a waveform of the second negative power voltage VSS2 of the first driving chip SIC1 when the first driving chip SIC1 outputs the data voltage, the C2 curve represents a waveform of the second negative power voltage VSS2 of the second driving chip SIC2 when the second driving chip SIC2 outputs the data voltage, the C3 curve represents a waveform of the second negative power voltage VSS2 of the third driving chip SIC3 when the third driving chip SIC3 outputs the data voltage, and the C4 curve represents a waveform of the second negative power voltage VSS2 of the fourth driving chip SIC4 when the fourth driving chip SIC4 outputs the data voltage.

As shown in FIG. 10, the first and second data output blocks DB11 to DB42 of the first to fourth driving chips SIC1, SIC2, SIC3 and SIC4 have driving timings different from one another so that the second negative power voltage VSS2 does not exceed the error reference voltage Ver. Thus, the level shifter 510 and the shift register 520 operate normally.

According to the present exemplary embodiment, the plurality of data output blocks DB11 to DB42 of the driving chips SIC1, SIC2, SIC3 and SIC4 have driving timings different from one another so that the second negative power voltage VSS2 in the signal wiring is prevented from exceeding the error reference voltage Ver. Thus, driving reliability may be improved.

In addition, when the plurality of data output blocks DB11 to DB42 of the driving chips SIC1, SIC2, SIC3 and SIC4 have driving timings different from one another, the second negative power voltage VSS2 in the signal wiring does not momentarily increase so that a relatively high resistance of the signal wiring is allowed. For example, when a thin and long signal wiring is employed, the width of a bezel of the display apparatus may decrease.

Figure 11:
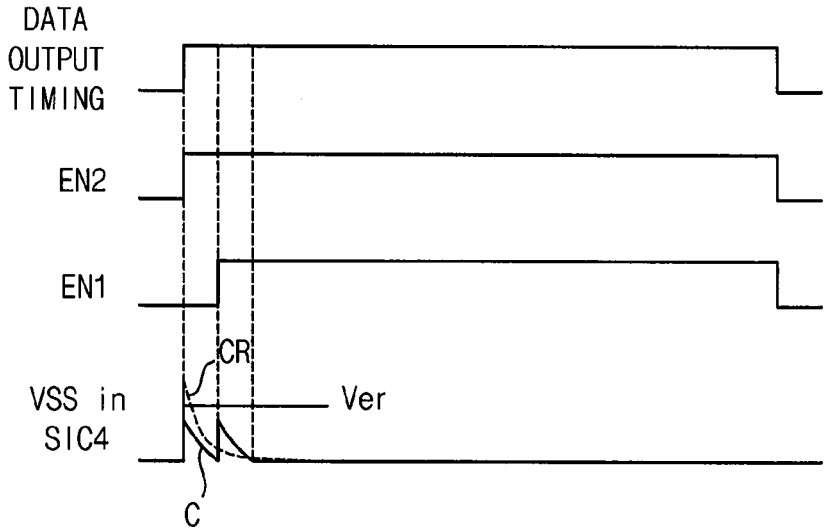
FIG. 11 is a waveform diagram illustrating signals in a data driver according to an exemplary embodiment of the present invention.

FIG. 11 is a waveform diagram illustrating signals in a data driver according to an exemplary embodiment of the present invention.

The method of driving the display panel and the display apparatus for performing the method are substantially the same as the method of driving the display panel and the display apparatus for performing the method of the previous exemplary embodiment explained with reference to FIGS. 8 to 10 except for the driving timing of the data output blocks of the driving chips. Thus, the same reference numerals will be used to refer to the same or like parts as those described in the previous exemplary embodiment of FIGS. 1 to 6, and any repetitive explanation concerning the above elements will be omitted.

Referring to FIGS. 1 to 3, 8 to 9D and 11, the display apparatus includes a display panel 100 and a panel driver. The panel driver includes a timing controller 200, a gate driver 300, a gamma reference voltage generator 400 and a data driver 500.

The data driver 500 includes a driving chip. For example, the data driver 500 may include a plurality of driving chips, and the data driver may include four driving chips SIC1, SIC2, SIC3 and SIC4. The data driver 500 includes a first driving chip SIC1, a second driving chip SIC2 adjacent to the first driving chip SIC1, a third driving chip SIC3 adjacent to the second driving chip SIC2 and a fourth driving chip SIC4 adjacent to the third driving chip SIC3.

The driving chip includes a plurality of data output blocks. The first driving chip SIC1 includes a first data output block DB11 and a second data output block DB12. The second driving chip SIC2 includes a first data output block DB21 and a second data output block DB22. The third driving chip SIC3 includes a first data output block DB31 and a second data output block DB32. The fourth driving chip SIC4 includes a first data output block DB41 and a second data output block DB42.

The driving chip may further include a control block. The first driving chip SIC1 may further include a first control block CB1. The second driving chip SIC2 may further include a second control block CB2. The third driving chip SIC3 may further include a third control block CB3. The fourth driving chip SIC4 may further include a fourth control block CB4. Each control block receives the second control signal CONT2 from the timing controller 200 so as to control an operation of the driving chip. For example, the control block may control output timings of the data output blocks.

The data driver 500 includes signal wirings L11 to L44 for transmitting a power voltage to the driving chips SIC1, SIC2, SIC3 and SIC4. In the present exemplary embodiment, a first group of the signal wirings L11 to L14 may be connected to the first driving chip SIC1. A second group of the signal wirings L21 to L24 may be connected to the second driving chip SIC2. A third group of the signal wirings L31 to L34 may be connected to the third driving chip SIC3. A fourth group of the signal wirings L41 to L44 may be connected to the fourth driving chip SIC4.

In FIG. 11, EN1 is an enable signal of the first data output blocks DB11, DB21, DB31 and DB41 of the first to fourth driving chips SIC1 to SIC4 representing driving timing of the first data output blocks DB11, DB21, DB31 and DB41 of the first to fourth driving chips SIC1 to SIC4 which output the data voltage. EN2 is an enable signal of the second data output blocks DB12, DB22, DB32 and DB42 of the first to fourth driving chips SIC1 to SIC4 representing driving timing of the second data output block DB12, DB22, DB32 and DB42 of the first to fourth driving chips SIC1 to SIC4 which output the data voltage.

In the present exemplary embodiment, the first data output block DB11 and the second data output block DB12 of the first driving chip SIC1 have driving timings different from each other. The first data output block DB21 and the second data output block DB22 of the second driving chip SIC2 have driving timings different from each other. The first data output block DB31 and the second data output block DB32 of the third driving chip SIC3 have driving timings different from each other. The first data output block DB41 and the second data output block DB42 of the fourth driving chip SIC4 have driving timings different from each other. The first to fourth driving chips SIC1 to SIC4 have the same driving timings as one another. Therefore, the first data output blocks DB11, DB21, DB31 and DB41 of the driving chips SIC1 to SIC4 commonly have a first driving timing. The second data output blocks DB12, DB22, DB32 and DB42 of the driving chips SIC1 to SIC4 commonly have a second driving timing.

In the present exemplary embodiment, when a distance of the driving chip from the signal wiring L11 to L44 transmitting the power voltage to the driving chip SIC1, SIC2, SIC3 and SIC4 is relatively far, driving timing of the driving chip SIC1, SIC2, SIC3 and SIC4 is relatively early.

In the present exemplary embodiment, the first data output blocks DB11, DB21, DB31 and DB41 of the first to fourth driving chips SIC1, SIC2, SIC3 and SIC4 and the second data output blocks DB12, DB22, DB32 and DB42 of the first to fourth driving chips SIC1, SIC2, SIC3 and SIC4 are controlled to have driving timings different from each other. In FIG. 11, the C curve represents a waveform of the second negative power voltage VSS2 of the first driving chip SIC1.

For example, a first rising waveform of the C curve is a waveform of the second negative power voltage VSS2 of the first driving chip SIC1 when the second data output blocks DB12, DB22, DB32 and DB42 of the first to fourth driving chips SIC1 to SIC4 output the data voltage. A second rising waveform of the C curve is a waveform of the second negative power voltage VSS2 of the first driving chip SIC1 when the first data output blocks DB11, DB21, DB31 and DB41 of the first to fourth driving chips SIC1 to SIC4 output the data voltage.

As shown in FIG. 11, the first data output blocks DB11, DB21, DB31 and DB41 of the first to fourth driving chips SIC1, SIC2, SIC3 and SIC4 have driving timing different from the driving timing of the second data output blocks DB12, DB22, DB32 and DB42 of the first to fourth driving chips SIC1, SIC2, SIC3 and SIC4 so that the second negative power voltage VSS2 does not exceed the error reference voltage Ver. Thus, the level shifter 510 and the shift register 520 operate normally.

According to the present exemplary embodiment, the first data output blocks DB11, DB21, DB31 and DB41 of the driving chips have driving timing different from driving timing of the second data output blocks DB12, DB22, DB32 and DB41 of the driving chips so that the second negative power voltage VSS2 in the signal wiring is prevented from exceeding the error reference voltage Ver. Thus, driving reliability may be improved.

In addition, when the first data output blocks DB11, DB21, DB31 and DB41 of the driving chips SIC1, SIC2, SIC3 and SIC4 and the second data output blocks DB12, DB22, DB32 and DB42 of the driving chips SIC1, SIC2, SIC3 and SIC4 have driving timings different from each other, the second negative power voltage VSS2 in the signal wiring does not momentarily increase so that a relatively high resistance of the signal wiring is allowed. For example, when a thin and long signal wiring is employed, the width of a bezel of the display apparatus may decrease.

Figure 12:
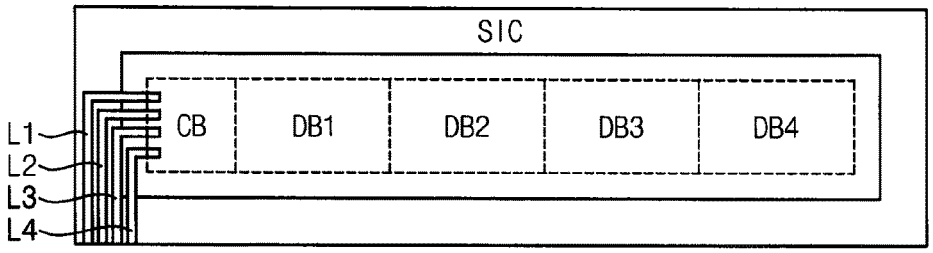
FIG. 12 is a plan view illustrating a driving chip and a wiring of a data driver according to an exemplary embodiment of the present invention.
Figure 13:
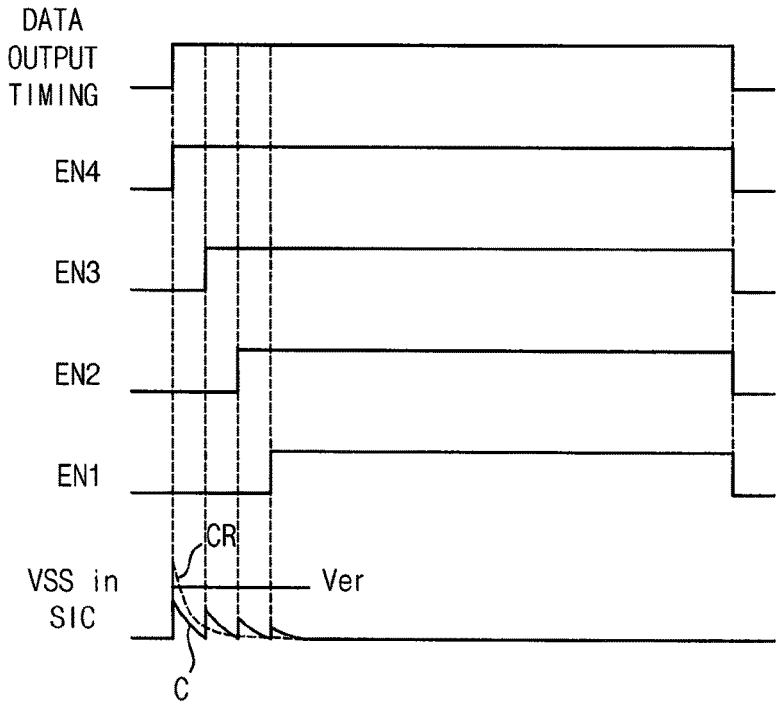
FIG. 13 is a waveform diagram illustrating signals in the data driver of FIG. 12.

FIG. 12 is a plan view illustrating a driving chip and a wiring of a data driver according to an exemplary embodiment of the present invention. FIG. 13 is a waveform diagram illustrating signals in the data driver of FIG. 12.

The method of driving the display panel and the display apparatus for performing the method are substantially the same as the method of driving the display panel and the display apparatus for performing the method of the previous exemplary embodiment explained referring to FIGS. 1 to 6 except that the data driver includes a single driving chip and the driving chip includes four data output blocks. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 3, 12 and 13, the data driver 500 includes a single driving chip SIC. The driving chip SIC includes a plurality of data output blocks. For example, the driving chip SIC includes a plurality of data output blocks, and the driving chip SIC includes first to fourth data output blocks DB1, DB2, DB3 and DB4.

The driving chip SIC may further include a control block CB. For example, the control block CB may control output timings of the data output blocks DB1, DB2, DB3 and DB4. The control block CB may be disposed at a side portion of the driving chip SIC. The control block CB may be disposed adjacent to the first data output block DB1.

Although the driving chip SIC includes four data output blocks in the present exemplary embodiment, the present invention is not limited to the number of data output blocks.

The data driver 500 includes signal wirings L1, L2, L3 and L4 for transmitting a power voltage to the driving chip SIC. In the present exemplary embodiment, the signal wirings L1, L2, L3 and L4 may be connected to the control block CB of the driving chip SIC.

For example, a first signal wiring L1 may transmit the second positive power voltage VDD2 to the driving chip SIC. A second signal wiring L2 may transmit the first positive power voltage VDD1 to the driving chip SIC. A third signal wiring L3 may transmit the first negative power voltage VSS1 to the driving chip SIC. A fourth signal wiring L4 may transmit the second negative power voltage VSS2 to the driving chip SIC.

In FIG. 13, EN1 is an enable signal of the first data output block DB1 representing driving timing of the first data output block DB1 which outputs the data voltage. EN2 is an enable signal of the second data output block DB2 representing driving timing of the second data output block DB2 which outputs the data voltage. EN3 is an enable signal of the third data output block DB3 representing driving timing of the third data output block DB3 which outputs the data voltage. EN4 is an enable signal of the fourth data output block DB4 representing driving timing of the fourth data output block DB4 which outputs the data voltage.

In the present exemplary embodiment, the first to fourth data output blocks DB1 to DB4 have driving timings different from one another.

In the present exemplary embodiment, when a distance of the data output block from the signal wiring L1 to L4 transmitting the power voltage to the driving chip SIC is relatively far, the driving timing of the data output block is relatively early. For example, the driving timing of the fourth data output block DB4 may be earlier than the driving timing of the first output block DB1 in the driving chip SIC.

Referring again to FIG. 3, when the second negative power voltage VSS2 exceeds the error reference voltage Ver, the level of the second power voltage VSS2 connected to the output electrodes of the first and second switching elements T1 and T2, the first and second switching elements T1 and T2 may not be normally turned on. Thus, the level shifter 510 operates abnormally and the shift register 520 and the buffer 550 may operate abnormally.

The first to fourth data output blocks DB1 to DB4 of the driving chip SIC of the present exemplary embodiment are controlled to have driving timings different from one another. In FIG. 13, the C curve represents a waveform of the second negative power voltage VSS2 of the driving chip SIC.

As shown in FIG. 13, the first to fourth data output blocks DB1 to DB4 of the driving chip SIC have driving timings different from one another so that the second negative power voltage VSS2 does not exceed the error reference voltage Ver. Thus, the level shifter 510 and the shift register 520 operate normally.

According to the present exemplary embodiment, the plurality of the data output blocks DB1 to DB4 of the driving chip SIC have driving timings different from one another so that the second negative power voltage VSS2 in the signal wiring is prevented from exceeding the error reference voltage Ver. Thus, driving reliability may be improved.

In addition, when the plurality of data output blocks DB1 to DB4 of the driving chip SIC have driving timings different from one another, the second negative power voltage VSS2 in the signal wiring does not momentarily increase so that a relatively high resistance of the signal wiring is allowed. For example, when a thin and long signal wiring is employed, the width of a bezel of the display apparatus may decrease.

Figure 14:
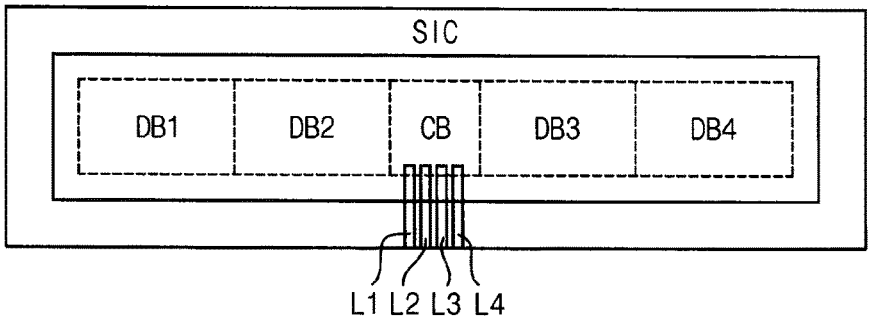
FIG. 14 is a plan view illustrating a driving chip and a wiring of a data driver according to an exemplary embodiment of the present invention.
Figure 15:
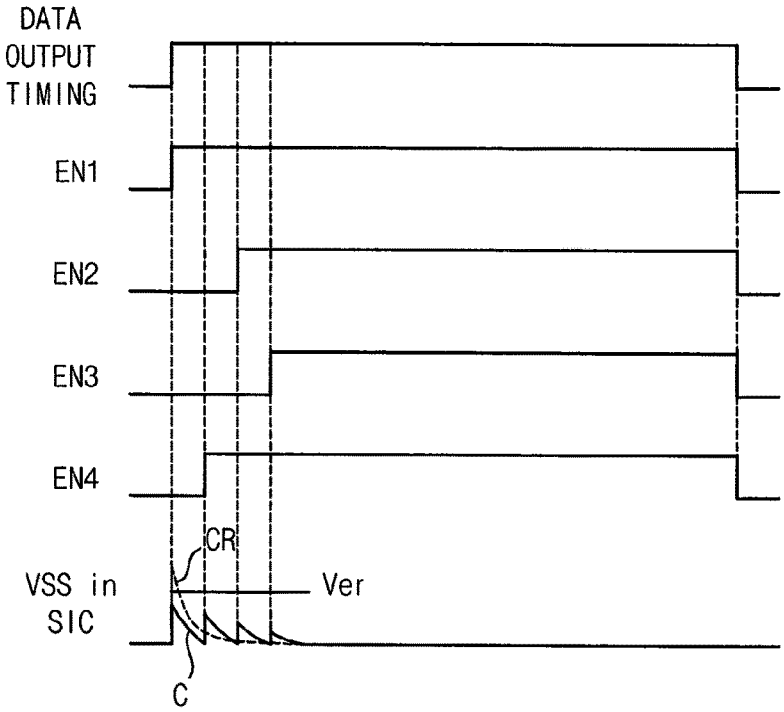
FIG. 15 is a waveform diagram illustrating signals in the data driver of FIG. 14.

FIG. 14 is a plan view illustrating a driving chip and a wiring of a data driver according to an exemplary embodiment of the present invention. FIG. 15 is a waveform diagram illustrating signals in the data driver of FIG. 14.

The method of driving the display panel and the display apparatus for performing the method are substantially the same as the method of driving the display panel and the display apparatus for performing the method of the previous exemplary embodiment explained with reference to FIGS. 12 and 13 except that the signal wiring is connected to a central portion of the driving chip. Thus, the same reference numerals will be used to refer to the same or like parts as those described in the previous exemplary embodiment of FIGS. 12 and 13 and any repetitive explanation concerning the above elements will be omitted.

Referring to FIGS. 1 to 3, 14 and 15, the data driver 500 includes a single driving chip SIC. The driving chip SIC includes a plurality of data output blocks. For example, the driving chip SIC includes a plurality of data output blocks, and the driving chip SIC includes first to fourth data output blocks DB1, DB2, DB3 and DB4.

The driving chip SIC may further include a control block CB. For example, the control block CB may control output timings of the data output blocks DB1, DB2, DB3 and DB4. The control block CB may be disposed at a central portion of the driving chip SIC. The control block CB may be disposed between the second data output block DB2 and the third data output block DB3.

Although the driving chip SIC includes four data output blocks in the present exemplary embodiment, the present invention is not limited to the number of data output blocks.

The data driver 500 includes signal wirings L1, L2, L3 and L4 for transmitting a power voltage to the driving chip SIC. In the present exemplary embodiment, the signal wiring L1, L2, L3 and L4 may be connected to the control block CB of the driving chip SIC.

For example, a first signal wiring L1 may transmit the second positive power voltage VDD2 to the driving chip SIC, a second signal wiring L2 may transmit the first positive power voltage VDD1 to the driving chip SIC, a third signal wiring L3 may transmit the first negative power voltage VSS1 to the driving chip SIC, and a fourth signal wiring L4 may transmit the second negative power voltage VSS2 to the driving chip SIC.

In FIG. 15, EN1 is an enable signal of the first data output block DB1 representing driving timing of the first data output block DB1 which outputs the data voltage. EN2 is an enable signal of the second data output block DB2 representing driving timing of the second data output block DB2 which outputs the data voltage. EN3 is an enable signal of the third data output block DB3 representing driving timing of the third data output block DB3 which outputs the data voltage. EN4 is an enable signal of the fourth data output block DB4 representing driving timing of the fourth data output block DB4 which outputs the data voltage.

In the present exemplary embodiment, the first to fourth data output blocks DB1 to DB4 have driving timings different from one another.

In the present exemplary embodiment, when a distance of the data output block from the signal wiring L1 to L4 transmitting the power voltage to the driving chip SIC is relatively far, the driving timing of the data output block is relatively early. For example, driving timings of the first and fourth data output blocks DB1 and DB4 may be earlier than driving timings of the second and third data output blocks DB2 and DB3 in the driving chip SIC. When a distance of the first data output block DB1 from the signal wiring L1 to L4 is far compared to a distance of the fourth data output block DB4 from the signal wiring L1 to L4, the driving timing of the first data output block DB1 is earlier than the driving timing of the fourth data output block DB4. When a distance of the first data output block DB1 from the signal wiring L1 to L4 is substantially the same as a distance of the fourth data output block DB4 from the signal wiring L1 to L4, the driving timing of the first data output block DB1 or the driving timing of the fourth data output block DB4 may be set to be earlier than the other. Alternatively, when a distance of the first data output block DB1 from the signal wiring L1 to L4 is substantially the same as a distance of the fourth data output block DB4 from the signal wiring L1 to L4, the driving timing of the first data output block DB1 and the driving timing of the fourth data output block DB4 may be set to be the same.

Referring again to FIG. 3, when the second negative power voltage VSS2 exceeds the error reference voltage Ver, the level of the second power voltage VSS2 connected to the output electrodes of the first and second switching elements T1 and T2, the first and second switching elements T1 and T2 may not be normally turned on. Thus, the level shifter 510 operates abnormally and the shift register 520 and the buffer 550 may operate abnormally.

The first to fourth data output blocks DB1 to DB4, respectively, of the driving chip SIC of the present exemplary embodiment are controlled to have driving timings different from one another. In FIG. 15, the C curve represents a waveform of the second negative power voltage VSS2 of the driving chip SIC.

As shown in FIG. 15, the first to fourth data output blocks DB1 to DB4 of the driving chip SIC have driving timings different from one another so that the second negative power voltage VSS2 does not exceed the error reference voltage Ver. Thus, the level shifter 510 and the shift register 520 operate normally.

According to the present exemplary embodiment, the plurality of data output blocks DB1 to DB4 of the driving chip SIC have driving timings different from one another so that the second negative power voltage VSS2 in the signal wiring is prevented from exceeding the error reference voltage Ver. Thus, driving reliability may be improved.

In addition, when the plurality of data output blocks DB1 to DB4 of the driving chip SIC have driving timings different from one another, the second negative power voltage VSS2 in the signal wiring does not momentarily increase so that a relatively high resistance of the signal wiring is allowed. For example, when a thin and long signal wiring is employed, the width of a bezel of the display apparatus may decrease.

According to the present invention as explained above, the data driver includes the plurality of data output blocks having driving timings different from one another so that driving reliability of the display apparatus may be improved and the width of the bezel may decrease.

The foregoing is illustrative of the present invention and is not to be construed as limiting thereof. Although exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a display panel, comprising:

outputting gate signals to a plurality gate lines of the display panel in response to first control signals; and outputting data voltages to a plurality of data lines of the display panel in response to second control signals using a plurality of driving chips, each of the driving chips includes a plurality of data output blocks, wherein a first of the data output blocks in each of the driving chips has a different timing than a second of the data output blocks in each of the driving chips, wherein when a distance of the first of the data output blocks from a signal wiring transmitting a power voltage to a first of the driving chips is relatively far as compared to a distance of the second of the data output blocks from the signal wiring transmitting the power voltage to the first of the driving chips, a driving timing of the first of the data output blocks of the first of the driving chips is relatively early as compared to a driving timing of the second of the data output blocks of the first of the driving chips.

2. The method of claim 1, wherein each of the driving chips further comprises a controller programmed and configured to control the driving timings of the data output blocks.

3. The method of claim 1, wherein all of the data output blocks of the driving chips have driving timings different from one another.

4. The method of claim 1, wherein each of the first of the data output blocks of each of the driving chips has a same first driving timing, and each of the second of the data output blocks of each of the driving chips has a same second driving timing that is different from the first driving timing.

5. The method of claim 1, wherein, when a resistance of the signal wiring transmitting the power voltage to the first of the driving chips is relatively high as compared to a resistance of the signal wiring transmitting the power voltage to a second of the driving chips, a driving timing of the first of the driving chips is relatively early as compared to a driving timing of the second of the driving chips.

6. The method of claim 5, wherein the signal wiring is sequentially connected to the first of the driving chips, the second of the driving chips adjacent to the first of the driving chips, a third of the driving chips adjacent to the second of the driving chips, and a fourth of the driving chips adjacent to the third of the driving chips.

7. The method of claim 6, wherein the fourth of the driving chips, the third of the driving chips, the second of the driving chips and the first of the driving chips sequentially output the data voltages.

8. The method of claim 5, wherein a first signal wiring is connected to the first of the driving chips, a second signal wiring is connected to the second of the driving chips, a third signal wiring is connected to a third of the driving chips, and a fourth signal wiring is connected to a fourth of the driving chips.

9. The method of claim 8, wherein the first and fourth of the driving chips correspond to an edge portion of the display panel and the second and third of the driving chips correspond to a central portion of the display panel, and wherein the first and fourth of the driving chips output the data voltages earlier than the second and third of the driving chips.

10. The method of claim 1, wherein the plurality of the driving chips are mounted on a substrate on which the gate lines and the data lines are arranged.

11. The method of claim 1, wherein the power voltage being output from a level shifter within a data driver which outputs the data voltages to the data lines.

12. A display apparatus, comprising:

a display panel including a plurality of gate lines and a plurality of data lines, the display panel displaying an image;

a timing controller to generate first control signals and second control signals;

a gate driver to output gate signals to the gate lines in response to the first control signals; and a data driver including a plurality of driving chips mounted on a substrate on which the gate lines and the data lines are arranged, each of the driving chips including a plurality of data output blocks, wherein a first of the data output blocks in each of the driving chips has a different timing than a second of the data output blocks in each of the driving chips, wherein when a distance of the first of the data output blocks from a signal wiring transmitting a power voltage to a first of the driving chips is relatively far as compared to a distance of the second of the data output blocks from the signal wiring transmitting the power voltage to the first of the driving chips, a driving timing of the first of the data output blocks of the first of the driving chips is relatively early as compared to a driving timing of the second of the data output blocks of the first of the driving chips.

13. The display apparatus of claim 12, wherein each of the driving chips further comprises a controller programmed and configured to control the driving timings of the data output blocks.

14. The display apparatus of claim 12, wherein all of the data output blocks of the driving chips have driving timings different from one another.

15. The display apparatus of claim 12, wherein each of the first of the data output blocks of each of the driving chips has a same first driving timing, and each of the second of the data output blocks of each of the driving chips has a same second driving timing that is different from the first driving timing.

16. The display apparatus of claim 12, wherein, when a resistance of the signal wiring connected to the first of the driving chips is relatively high as compared to a resistance of the signal wiring connected to a second of the driving chips, a driving timing of the first of the driving chips is relatively early as compared to a driving timing of the second of the driving chips.

* * * * *